US008657703B2

(12) United States Patent
Wada et al.

(10) Patent No.: US 8,657,703 B2
(45) **Date of Patent: *Feb. 25, 2014**

(54) GOLF CLUB HEAD

(75) Inventors: Kozue Wada, Chichibu (JP); Wataru Ban, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 115 days.

This patent is subject to a terminal disclaimer.

(21) Appl. No.: 13/163,051

(22) Filed: Jun. 17, 2011

(65) Prior Publication Data

US 2012/0142450 A1 Jun. 7, 2012

(30) Foreign Application Priority Data

Dec. 7, 2010 (JP) ..... 2010-273005

(51) Int. Cl.
*A63B 53/04* (2006.01)

(52) U.S. Cl.
USPC ..... 473/335; 473/345; 473/346; 473/349

(58) Field of Classification Search
USPC ..... 473/324–350, 287–292
See application file for complete search history.

(56) References Cited

U.S. PATENT DOCUMENTS

| | | | | |
|---|---|---|---|---|
| 1,575,364 | A * | 3/1926 | Hodgkins | 473/311 |
| 5,547,427 | A | 8/1996 | Rigal et al. | |
| 5,570,886 | A | 11/1996 | Rigal et al. | |
| 6,572,491 | B2 * | 6/2003 | Hasebe et al. | 473/349 |
| 6,623,376 | B2 | 9/2003 | Poynor | |
| 6,773,360 | B2 | 8/2004 | Willett et al. | |
| 6,783,465 | B2 | 8/2004 | Matsunaga | |
| 6,821,214 | B2 | 11/2004 | Rice | |
| 6,932,718 | B2 | 8/2005 | Nishitani | |
| 6,945,877 | B2 * | 9/2005 | Kobayashi et al. | 473/345 |
| 6,994,635 | B2 | 2/2006 | Poynor | |
| 7,056,228 | B2 * | 6/2006 | Beach et al. | 473/345 |
| 7,273,423 | B2 | 9/2007 | Imamoto | |
| 7,377,861 | B2 * | 5/2008 | Tateno et al. | 473/345 |
| 7,390,271 | B2 * | 6/2008 | Yamamoto | 473/345 |
| 7,431,668 | B2 * | 10/2008 | Tateno et al. | 473/346 |
| 7,435,191 | B2 * | 10/2008 | Tateno et al. | 473/346 |
| 7,530,901 | B2 * | 5/2009 | Imamoto et al. | 473/334 |
| 7,559,854 | B2 | 7/2009 | Harvell et al. | |
| 7,572,193 | B2 * | 8/2009 | Yokota | 473/328 |
| 7,758,453 | B2 * | 7/2010 | Horacek et al. | 473/345 |
| 7,798,913 | B2 * | 9/2010 | Noble et al. | 473/324 |
| 7,803,067 | B2 * | 9/2010 | Horacek et al. | 473/345 |
| 7,806,781 | B2 | 10/2010 | Imamoto | |

(Continued)

FOREIGN PATENT DOCUMENTS

| | | |
|---|---|---|
| JP | 3050385 U | 7/1998 |
| JP | 11-155982 A | 6/1999 |

(Continued)

*Primary Examiner* — Sebastiano Passaniti
(74) *Attorney, Agent, or Firm* — Sughrue Mion, PLLC

(57) ABSTRACT

This invention provides a hollow golf club head including a face portion, a crown portion, and a sole/side portion including a sole portion and a side portion. This golf club head includes a rib which extends from the toe side to the heel side in the sole portion, and a weight portion which is provided in the sole portion on the side of the face portion with respect to the rib or the back side with respect to the rib, and increases the amplitude of vibration of the sole portion.

13 Claims, 6 Drawing Sheets

(56) References Cited

U.S. PATENT DOCUMENTS

| | | | | |
|---|---|---|---|---|
| 7,850,545 | B2 * | 12/2010 | Wada et al. | 473/332 |
| 8,029,385 | B2 * | 10/2011 | Horacek et al. | 473/345 |
| 8,033,932 | B2 * | 10/2011 | Wada et al. | 473/346 |
| 2004/0121853 | A1 * | 6/2004 | Caldwell et al. | 473/345 |
| 2007/0049405 | A1 * | 3/2007 | Tateno et al. | 473/345 |
| 2007/0149313 | A1 * | 6/2007 | Matsunaga et al. | 473/332 |
| 2010/0022327 | A1 * | 1/2010 | Nakano | 473/346 |
| 2010/0048324 | A1 * | 2/2010 | Wada et al. | 473/346 |
| 2010/0160074 | A1 | 6/2010 | Wada et al. | |
| 2011/0312440 | A1 * | 12/2011 | Wada et al. | 473/346 |
| 2012/0322580 | A1 * | 12/2012 | Wada et al. | 473/346 |

FOREIGN PATENT DOCUMENTS

| | | | |
|---|---|---|---|
| JP | 2001-129130 | A | 5/2001 |
| JP | 2001-353240 | A | 12/2001 |
| JP | 2002-186691 | A | 7/2002 |
| JP | 2003-088601 | A | 3/2003 |
| JP | 2003-102877 | A | 4/2003 |
| JP | 2003-126309 | A | 5/2003 |
| JP | 2003-275345 | A | 9/2003 |
| JP | 2003-339922 | A | 12/2003 |
| JP | 2005-160947 | A | 6/2005 |
| JP | 2006-223859 | A | 8/2006 |
| JP | 2007-054166 | A | 3/2007 |
| JP | 2010-142448 | A | 7/2010 |

* cited by examiner

FIG. 6

| | RIB | WEIGHT | THICK REGION | HEIGHT | RESONANCE | LOUDNESS |
|---|---|---|---|---|---|---|
| #1 | ○ | ○ | ○ | A | A | A |
| #2 | ○ | ○ | × | B | A | A |
| #3 | × | × | × | C | B | B |
| #4 | ○ | × | × | A | A | C |
| #5 | ○ | × | ○ | B | C | C |

GOLF CLUB HEAD

BACKGROUND OF THE INVENTION

1. Field of the Invention

The present invention relates to a golf club head and, more particularly, to a technique for improving an impact sound.

2. Description of the Related Art

Techniques for improving an impact sound by appropriately designing the hollow body construction have been proposed in hollow golf club heads typified by a driver head. For example, Japanese Patent Laid-Open Nos. 11-155982 and 2003-275345 disclose techniques for improving an impact sound by partially varying the thickness of a sole portion. Also, Japanese Patent Laid-Open Nos. 2002-186691 and 2003-102877 disclose techniques for improving an impact sound by providing a rib in a sole portion.

Since the volume of a hollow golf club head has been increasing every year, the crown portion and sole portion of the hollow golf club head are becoming thinner, while their areas are increasing together with this trend. Thus, a low-pitched impact sound is more likely to be generated when a golf ball is struck. Under the circumstance, golfers who prefer high-pitched impact sounds want golf club heads that generate higher-pitched impact sounds. Partially varying the thickness of a sole portion produces a certain effect of increasing the pitch of an impact sound, as disclosed in Japanese Patent Laid-Open Nos. 11-155982 and 2003-275345. Providing a rib in a sole portion also produces a certain effect of increasing the pitch of an impact sound, as disclosed in Japanese Patent Laid-Open Nos. 2002-186691 and 2003-102877. These techniques increase the pitch of an impact sound by increasing the degree of constraint of the sole portion. However, as the degree of constraint of the sole portion increases, an impact sound is more likely to be less loud and have poor resonance.

SUMMARY OF THE INVENTION

It is an object of the present invention to provide a golf club head that generates a higher-pitched, louder impact sound even when the volume of its head is increased.

According to the present invention, there is provided a hollow golf club head including a face portion, a crown portion, and a sole/side portion which includes a sole portion and a side portion, comprising: a rib which extends from a toe side to a heel side in the sole portion; and a weight portion which is provided in the sole portion on one of a side of the face portion with respect to the rib and a back side with respect to the rib, and increases an amplitude of vibration of the sole portion.

Further features of the present invention will become apparent from the following description of exemplary embodiments with reference to the attached drawings.

BRIEF DESCRIPTION OF THE DRAWINGS

FIG. 6 is a table showing the specifications of golf club heads #1 to #5 and their vibration analysis results obtained at the time of impact.

DESCRIPTION OF THE EMBODIMENTS

Figure 1:
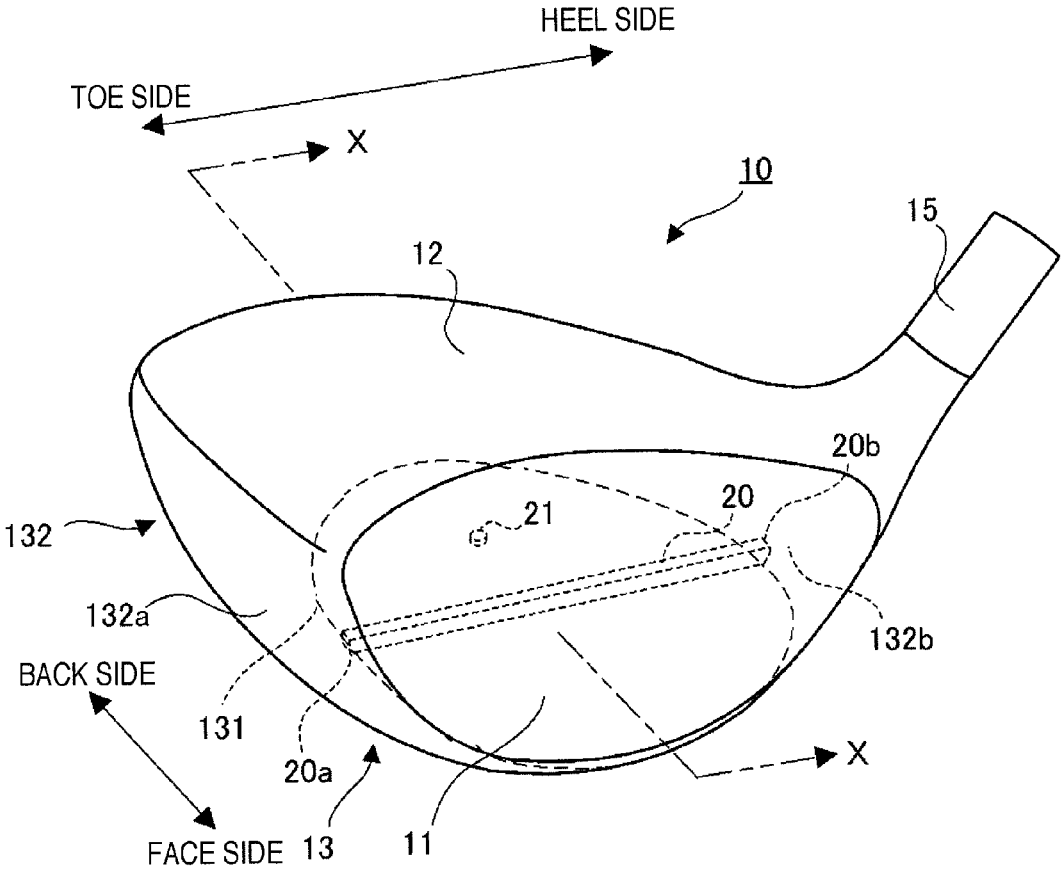
FIG. 1 is a perspective view of a golf club head 10 according to an embodiment of the present invention.
Figure 2A:
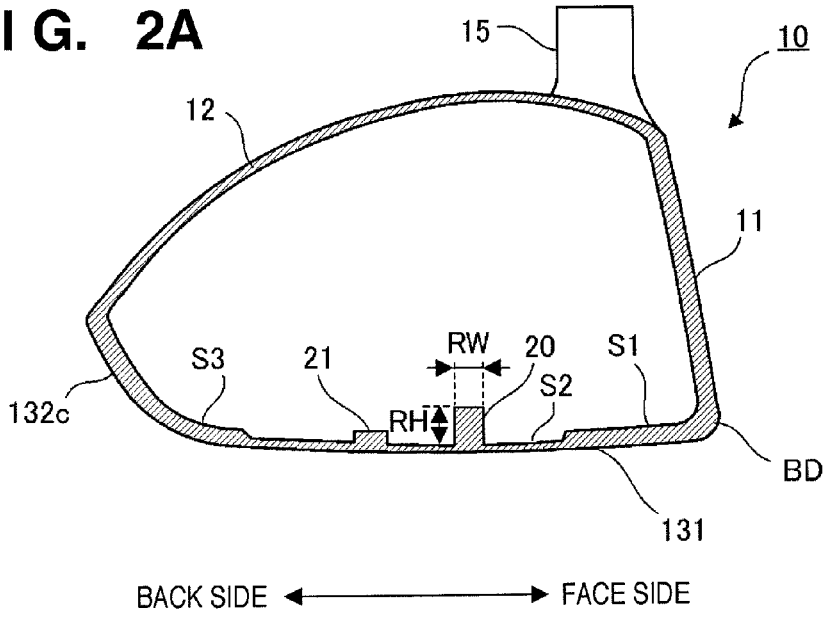
FIG. 2A is a sectional view taken along a line X-X in FIG. 1.
Figure 2B:
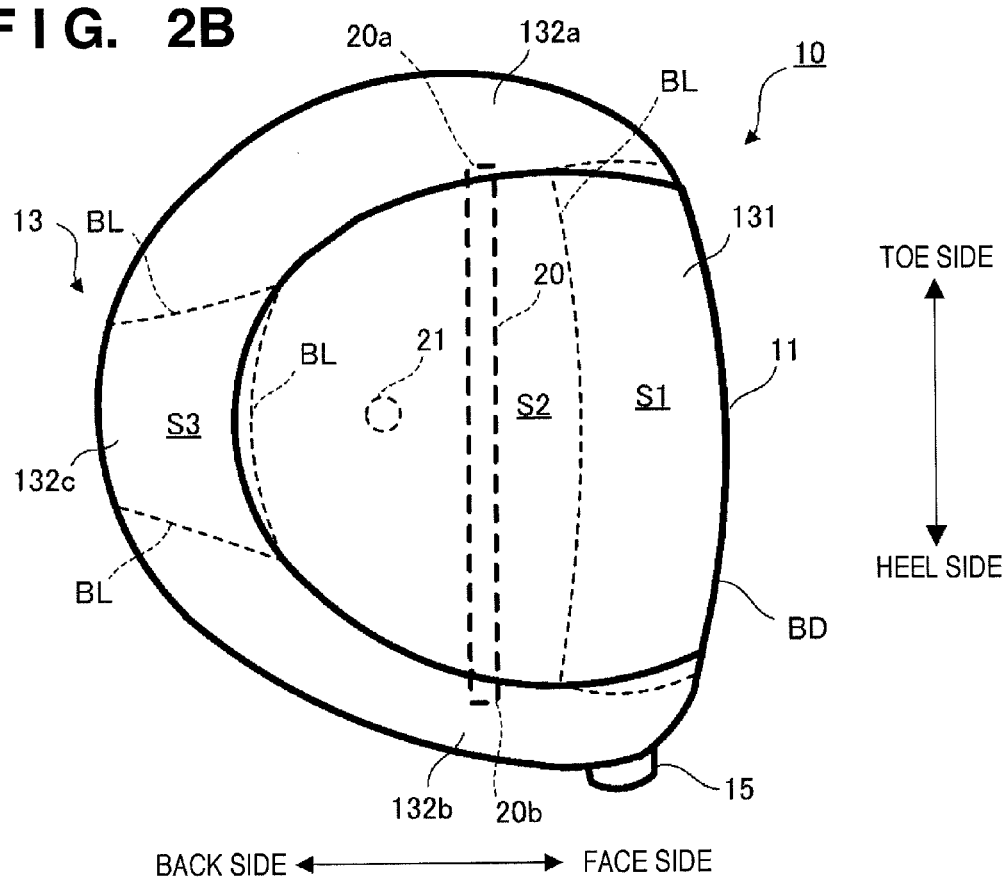
FIG. 2B is a view of the golf club head 10 when viewed from the side of a sole portion 131.

FIG. 1 is a perspective view of a golf club head 10 according to an embodiment of the present invention when a rib 20 and a weight portion 21 which are provided in it are seen through, FIG. 2A is a sectional view taken along a line X-X in FIG. 1, and FIG. 2B is a view of the golf club head 10 when viewed from the side of a sole portion 131.

The golf club head 10 takes the form of a hollow body, and its peripheral wall forms a face portion 11 which forms a face surface (striking surface), a crown portion 12 which forms the upper portion of the golf club head 10, and a sole/side portion 13. The sole/side portion 13 forms the sole portion 131 which forms the bottom portion of the golf club head 10, and a side portion 132 between the crown portion 12 and the sole portion 131. The side portion 132 forms the side portion of the golf club head 10, and includes a toe-side side portion 132*a*, heel-side side portion 132*b*, and back-side side portion 132*c*. The golf club head 10 also includes a hosel portion 15 to which a shaft is attached.

The golf club head 10 is a driver golf club head. However, the present invention is applicable not only to driver golf club heads but also to wood type golf club heads including, for example, a fairway wood type golf club head, utility (hybrid) golf club heads, and other hollow golf club heads. The golf club head 10 can be made of a metal material such as a titanium-based metal (for example, Ti-6Al-4V titanium alloy), stainless steel, or a copper alloy such as beryllium copper.

The golf club head 10 can be assembled by bonding a plurality of parts. The golf club head 10 can be formed from, for example, a main body member and a face member. The main body member forms the peripheral portions of the crown portion 12, sole portion 131, side portion 132, and face portion 11, and has an opening partially formed in a portion corresponding to the face portion 11. The face member is bonded into the opening in the main body member.

Referring to FIGS. 1, 2A, and 2B, the elongated rib 20 and the point-like weight portion 21 are formed on the inner upper surface of the sole portion 131. None of the outer surface of the point-like weight portion 21 is connected to the golf club head 10 except for the where it contacts the sole portion 131. The rib 20 adjusts the natural frequency of the golf club head 10. The weight portion 21 increases the amplitude of vibration of the sole portion 131 at the time of impact.

In this embodiment, the rib 20 traverses the sole portion 131 in the toe-to-heel direction, and has its one end 20*a* connected to the toe-side side portion 132*a*, and its other end 20*b* connected to the heel-side side portion 132*b*. Although the rib 20 is shaped integrally with the sole portion 131 and side portions 132*a* and 132*b* in this embodiment, it may be provided as a separate member and firmly fixed on the sole portion 131 and side portions 132*a* and 132*b*.

Also, although an arrangement in which the rib 20 is connected to the side portions 132*a* and 132*b* is adopted in this embodiment, the rib 20 may be connected to the crown portion 12 by extending it to an upper position. This arrangement improves the effect of constraining the sole portion 131. Also, in this case, either an arrangement in which the rib 20 and the side portions 132*a* and 132*b* are connected or that in which they are not connected can be adopted.

As shown in FIG. 2A, the rib 20 has a height RH and width RW. The height RH is the height of the rib 20 from the upper surface of the sole portion 131 (thin region S2). In this embodiment, the height RH and width RW satisfy a relation: height RH>width RW. When the rib 20 has the same cross-sectional area, the effect of constraining the sole portion 131 is greater when height RH>width RW as in this embodiment than when height RH<width RW. The height RH is, for example, 3 mm (inclusive) to 10 mm (inclusive), and the width RW is, for example, 0.5 mm (inclusive) to 3 mm (inclusive).

The weight portion 21 increases the amplitude of vibration of its periphery. Hence, the weight portion 21 has a weight of, for example, 1 to 5 g. Although the weight portion 21 has a circular cylindrical shape in this embodiment, it may have other shapes. Although the weight portion 21 is shaped integrally with the sole portion 131 by locally increasing the thickness of the sole portion 131 in this embodiment, it may be attached to the sole portion 131 as a separate member. If the weight portion 21 is provided as a separate member, it preferably uses a member (for example, a screw) having a specific gravity higher than a material which forms the sole portion 131. Again, if the weight portion 21 is provided as a separate member, it may be detachable from the sole portion 131 so as to be replaced with another weight portion 21 having a different weight. With this arrangement, the user can perform impact sound adjustment.

Although the weight portion 21 is positioned on the back side with respect to the rib 20 in this embodiment, it may be disposed on the side of the face portion 11. Nevertheless, as the position of the rib 20 comes closer to the face portion 11, it is easier to increase the eigenvalue (natural frequency) of the first-order vibration mode of the sole portion 131.

To increase the amplitude of vibration of the sole portion 131, the weight portion 21 is preferably disposed at the position of an antinode of vibration of the sole portion 131 or on its periphery. The position of an antinode of vibration of the sole portion 131 generally falls within an intermediate region in both the toe-to-heel direction and the face-to-back direction when viewed from the bottom side of the golf club head. Hence, the weight portion 21 is preferably disposed in the intermediate region.

Figure 3:
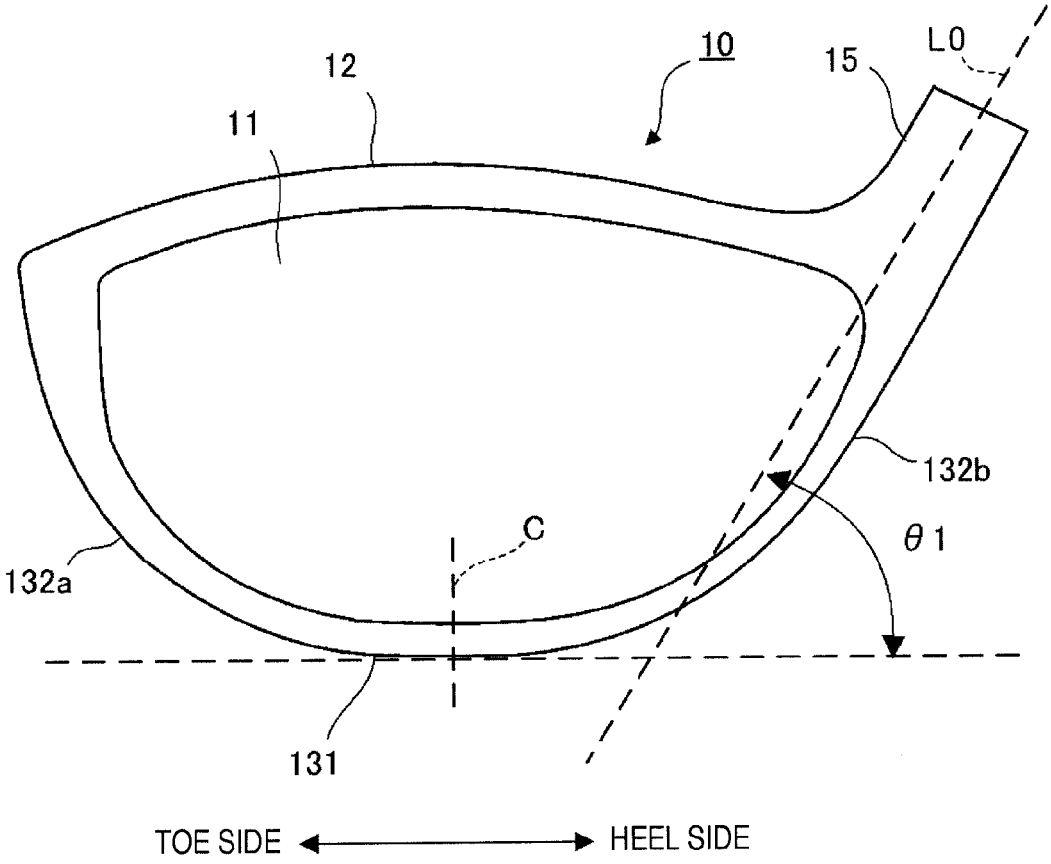
FIG. 3 is a front view of the golf club head 10 when viewed from the side of a face portion 11.

An intermediate region can be specified in the following way. First, as shown in FIG. 3, when the golf club head 10 is grounded such that an angle θ1 (lie angle) formed between a shaft axis line L0 and the grounding surface becomes a specific lie angle defined for the golf club head 10, and the loft angle becomes a specific loft angle (this grounding state will be referred to as specific grounding hereinafter), a grounding point C of the sole portion 131 is determined as a point on the center line of the dimension of the golf club head 10 in the toe-to-heel direction. Note that when the sole portion 131 is grounded in a plane defined on the grounding surface, its grounding point C is determined as the center in the widthwise direction.

Figure 4:
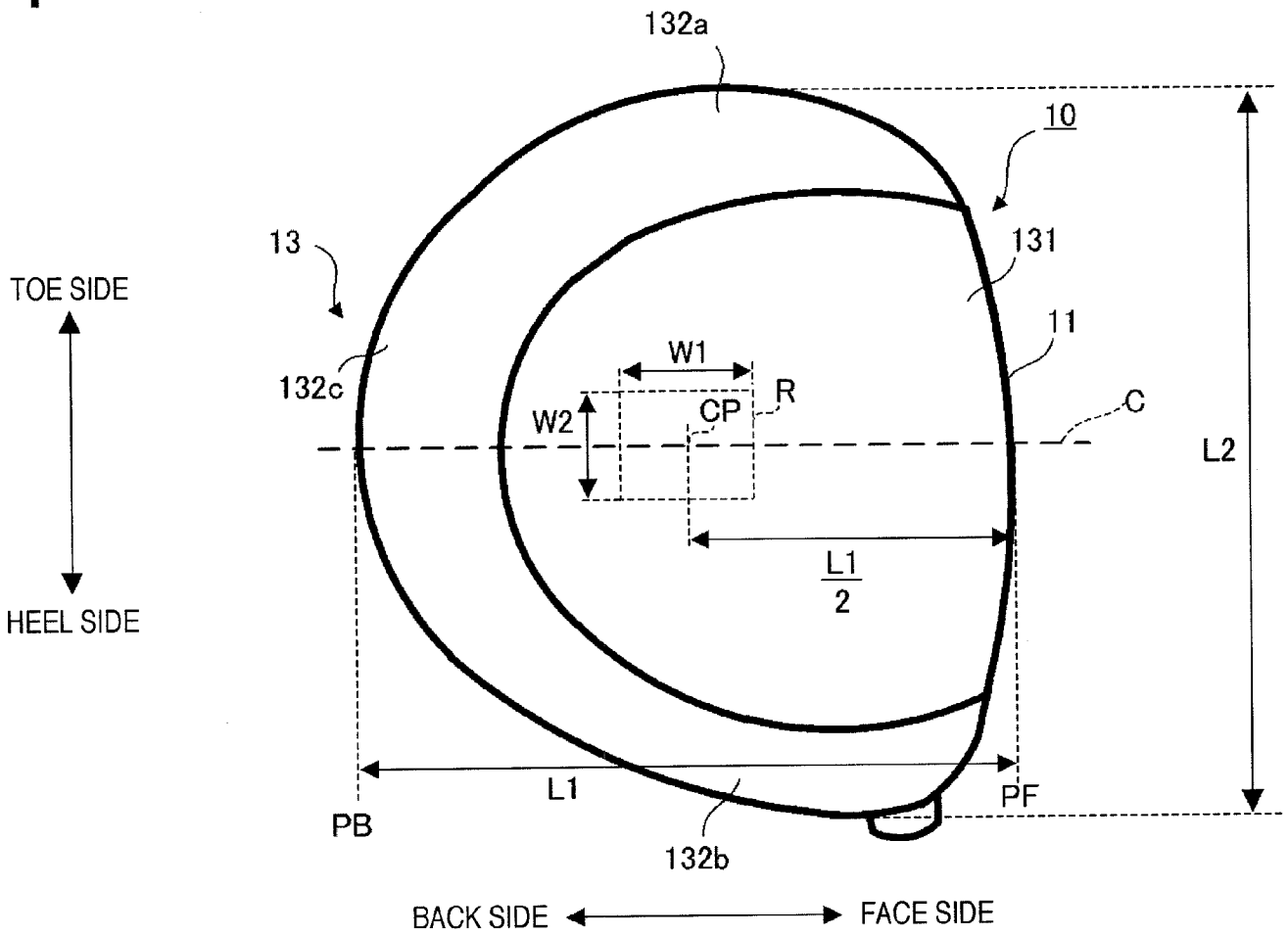
FIG. 4 is a view for explaining an intermediate region.

Next, as shown in FIG. 4, an intersection point PF between the face portion 11 and a face parallel to the center line defined by the grounding point C, and an intersection point PB between the back end and this face, both when the golf club head 10 is viewed from its bottom side while being kept in a specific grounding state, are defined. Then, a position CP one half of a distance L1 between the intersection points PF and PB is defined as the center point. Also, the dimension of the golf club head 10 in the toe-to-heel direction is defined as L2.

An intermediate region R can be defined by its dimension W1 in the face-to-back direction (flight trajectory direction) and its dimension W2 in the toe-to-heel direction upon defining the position CP as its center. The dimension W1 can be, for example, 0.4×L1 to 0.6 L×1, and the dimension W2 can be, for example, 0.4×L2 to 0.6×L2.

Next, referring to FIG. 2B, in this embodiment, the sole/side portion 13 includes a thick region S1 on the face portion side, a thin region S2, and a thick region S3 on the back side in turn from the side of the face portion 11 to the back side. In this embodiment, the rib 20 and weight portion 21 are disposed in the thin region S2. A plurality of lines BL indicate the boundary lines between the regions S1 to S3.

The thicknesses of the peripheral wall in the regions S1 to S3 satisfy relations: S1>S2 and S3>S2. The thin region S2 has a thickness of, for example, 0.8 mm, the thick region S1 has a thickness of, for example, 1.4 mm, and the thick region S3 has a thickness of, for example, 1.3 mm. Also, the face portion 11 has a thickness of, for example, 3 mm, and the crown portion 12 has a thickness of, for example, 0.6 (inclusive) to 0.7 mm (inclusive).

The thin region S2 is formed to traverse at least the sole portion 131 from the toe side to the heel side. Although the thin region S2 extends even to the side portions 132*a* and 132*b* in this embodiment, it may be formed only in the sole portion 131.

The thick region S1 is formed on the side of the face portion 11 with respect to the thin region S2 to be adjacent to the thin region S2. In this embodiment, the thick region S1 starts from a boundary portion BD between the sole portion 131 and the face portion 11, and extends up to the thin region S2. Although the thick region S1 extends even to the side portions 132*a* and 132*b* in this embodiment, it may be formed only in the sole portion 131. In this case, the thick region S1 may be formed only in part of the sole portion 131.

The thick region S3 is formed on the back side (on the side of the back-side side portion 132*c*) with respect to the thin region S2 to be adjacent to the thin region S2. Although the thick region S3 extends even to the side portions 132*a* and 132*b* and back-side side portion 132*c* in this embodiment, it may be formed only in the sole portion 131, only in the sole portion 131 and back-side side portion 132*c*, or only in the sole portion 131 and side portions 132*a* and 132*b*.

The principle of improving an impact sound in this embodiment will be described next. In general, with an increase in head volume, the head peripheral wall needs to be thinner and the area of each portion increases, so the eigenvalue of the entire head decreases, and the eigenvalue (natural frequency) of the first-order vibration mode of the sole portion 131, in turn, decreases. Thus, a low-pitched impact sound is more likely to be generated at the time of striking a golf ball in that case. In this embodiment, the sole portion 131 is constrained by providing the rib 20, so the eigenvalue of its first-order vibration mode increases. This makes it possible to increase the pitch of an impact sound.

As the degree of constraint of the sole portion 131 is increased using the rib 20, an impact sound can have a higher pitch but still has low loudness and poor resonance. However, in this embodiment, because the weight portion 21 is provided, the amplitude of vibration of the sole portion 131 at the time of impact increases. Thus, a higher-pitched, louder impact sound can be generated even when the head volume increases. The head volume is, for example, 400 cc (inclusive) to 460 cc (inclusive).

Also, in this embodiment, because the thick region S1, the thin region S2, and the thick region S3 are formed in the sole/side portion 13 in turn from the face side to the back side, the thin region S2 is more likely to vibrate at the time of striking a golf ball. By providing the rib 20 in the thin region S2, the thin region S2 is constrained by the rib 20, thus making it possible to further increase the pitch of an impact sound. Further, providing the weight portion 21 in the thin region S2 that is more likely to vibrate makes it possible to further increase the amplitude of vibration, thus improving both the loudness and resonance of an impact sound.

EXAMPLE

Figure 5:
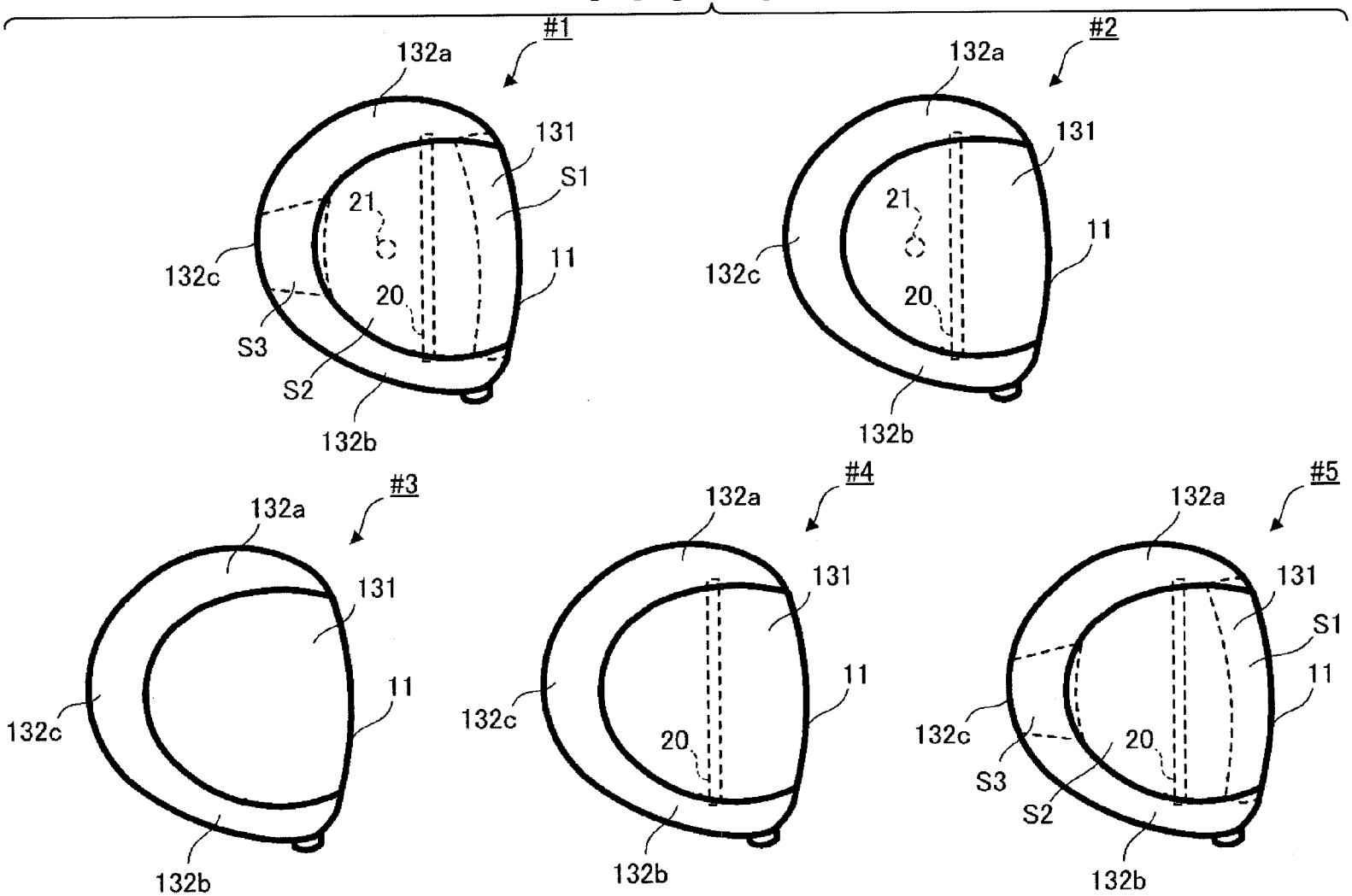
FIG. 5 shows views for explaining golf club heads #1 to #5.

Models of five golf club heads were designed on a computer, and vibration analysis was performed for each model on the computer. FIG. 5 shows views for explaining golf club heads #1 to #5 when viewed from the sides of their sole portions. The same reference numerals denote arrangements corresponding to the above-described embodiment. Also, FIG. 6 is a table showing the specifications of golf club heads #1 to #5 and their vibration analysis results obtained at the time of impact.

Golf club heads #1 to #5 are driver heads with the same shape and the same volume of 460 cc, and are different only in thickness distribution of a sole/side portion 13, in presence/absence of a rib 20, and in presence/absence of a weight portion 21. Golf club heads #1 to #5 are made of a titanium alloy (Ti-6Al-4V).

Golf club head #1 has the same arrangement as the golf club head 10 shown in FIGS. 1, 2A, and 2B, and includes a rib 20, a weight portion 21, and a sole/side portion 13 which includes a thick region S1 on the face portion side, a thin region S2, and a thick region S3 on the back side in turn from the side of a face portion 11 to the back side.

Golf club head #2 is obtained by altering golf club head #1 so that a sole/side portion 13 is formed to have a uniform thickness (the same thickness as the thin region S2) in place of a varying thickness. Golf club head #3 is obtained by altering golf club head #1 so that neither a rib 20 nor a weight portion 21 is provided and a sole/side portion 13 is formed to have a uniform thickness (the same thickness as the thin region S2) in place of a varying thickness. Golf club head #4 is obtained by altering golf club head #1 so that no weight portion 21 is provided and a sole/side portion 13 is formed to have a uniform thickness (the same thickness as the thin region S2) in place of a varying thickness. Golf club head #5 is obtained by altering golf club head #1 so that no weight portion 21 is provided.

As shown in FIG. 6, analysis was performed by calculating the pitch (frequency), resonance (vibration time), and loudness (amplitude) of an impact sound, and evaluating the calculation results using three ranks (A to C). Note that rank A is best of all. Golf club head #1 ranked A in terms of all of the pitch, resonance, and loudness of an impact sound. Golf club head #2 is inferior in terms of the pitch of an impact sound to golf club head #1. As can be seen from a comparison between golf club heads #1 and #2, providing the thick region S1, thin region S2, and thick region S3 in the sole/side portion 13 produces an effect of increasing the pitch of an impact sound.

Also, as can be seen from comparisons between golf club head #3 and the remaining golf club heads, providing the rib 20 produces an effect of increasing the pitch of an impact sound as well. Moreover, as can be seen from comparisons between golf club heads #1 and #2 and golf club heads #3 to #5, providing the weight portion 21 produces an effect of improving both the loudness and resonance of an impact sound.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-273005, filed Dec. 7, 2010, which is hereby incorporated by reference herein in its entirety.

What is claimed is:

1. A hollow golf club head including a face portion, a crown portion, and a sole/side portion which includes a sole portion and a side portion, comprising:

a rib which extends from a toe side to a heel side in the sole portion; and a weight portion which is provided in the sole portion on one of a side of the face portion with respect to said rib and aback side with respect to said rib, and increases an amplitude of vibration of the sole portion, wherein the sole/side portion includes a thick region on the side of the face portion, a thin region, and a thick region on the back side in turn from the side of the face portion to the back side, wherein said weight portion comprises a protrusion protruding from said sole portion, no outer surface of said protrusion is connected to any portion of said head other than said sole portion, and said rib and said protrusion are disposed in the thin region and are not disposed in the thick regions.

2. The head according to claim 1, wherein a head volume is not less than 400 cc.

3. The head according to claim 1, wherein said rib is connected to the side portion on the toe side and the side portion on the heel side.

4. The head according to claim 1, wherein said weight portion is provided on the back side with respect to said rib, and is disposed in an intermediate region in both a toe-to-heel direction and a face-to-back direction when viewed from a bottom side of the golf club head.

5. The head according to claim 1, wherein a weight of the weight portion ranges from 1 to 5 grams.

6. The head according to claim 1, wherein the weight portion is disposed at an antinode of vibration of the sole portion.

7. The head according to claim 6, wherein said weight portion is detachable from said sole portion.

8. The head according to claim 6, wherein said protrusion has a circular cylindrical shape.

9. The head according to claim 1, wherein said weight portion is detachable from said sole portion.

10. The head according to claim 1, wherein said protrusion has a circular cylindrical shape.

11. A hollow golf club head including a face portion, a crown portion, and a sole/side portion which includes a sole portion and a side portion, comprising:

a rib which extends from a toe side to a heel side in the sole portion; and a pointed weight portion which is provided in the sole portion on one of a side of the face portion with respect to said rib and a back side with respect to said rib, and increases an amplitude of vibration of the sole portion, wherein the sole/side portion includes a thick region on the side of the face portion, a thin region, and a thick region on the back side in turn from the side of the face portion to the back side, wherein said pointed weight portion comprises a protrusion protruding from said sole portion, no outer surface of said protrusion is connected to any portion of said head other than said sole portion, and said rib and said protrusion are disposed in the thin region and are not disposed in the thick regions.

12. The head according to claim 11, wherein a weight of the weight portion ranges from 1 to 5 grams.

13. The head according to claim 11, wherein the weight portion is disposed at an antinode of vibration of the sole portion.

* * * * *